United States Patent [19]

Kuwana

[11] Patent Number: 4,487,669

[45] Date of Patent: Dec. 11, 1984

[54] METHOD FOR OXIDATION OF AN ELEMENT IN BOTH COMPARTMENTS OF AN ELECTROLYTIC CELL

[75] Inventor: Theodore Kuwana, Worthington, Ohio

[73] Assignee: Koppers Company, Inc.

[21] Appl. No.: 462,310

[22] Filed: Jan. 31, 1983

[51] Int. Cl.[3] ..... C25B 1/00; C25B 1/30

[52] U.S. Cl. ..... 204/101; 204/84; 204/128; 423/502; 260/694

[58] Field of Search ..... 204/84, 101, 128; 423/502; 260/694

[56] References Cited

U.S. PATENT DOCUMENTS

| | | | |
|---|---|---|---|
| 3,793,173 | 2/1974 | Kawahata et al. | 204/272 |
| 4,021,321 | 3/1977 | White | 204/103 |
| 4,110,180 | 8/1978 | Nidola et al. | 204/128 |
| 4,182,662 | 1/1980 | Hart | 204/128 |

FOREIGN PATENT DOCUMENTS

| | | | |
|---|---|---|---|
| 872951 | 6/1971 | Canada | 204/84 |
| 785723 | 11/1957 | United Kingdom | 204/128 |

*Primary Examiner*—Winston A. Douglas
*Assistant Examiner*—Terryence Chapman
*Attorney, Agent, or Firm*—Donald M. MacKay; Herbert J. Zeh, Jr.

[57] ABSTRACT

A method of oxidizing an element in both compartments of an electrolytic cell is provided. The method comprises reducing $O_2$ to $H_2O_2$ in the cathodic compartment with a reducing agent such as a cobalt porphyrin, cobalt phthalocyanine, or hydroquinone, and oxidizing the element in both compartments preferably in the presence of a halide. Yields of up to 200 percent are obtainable.

20 Claims, 1 Drawing Figure

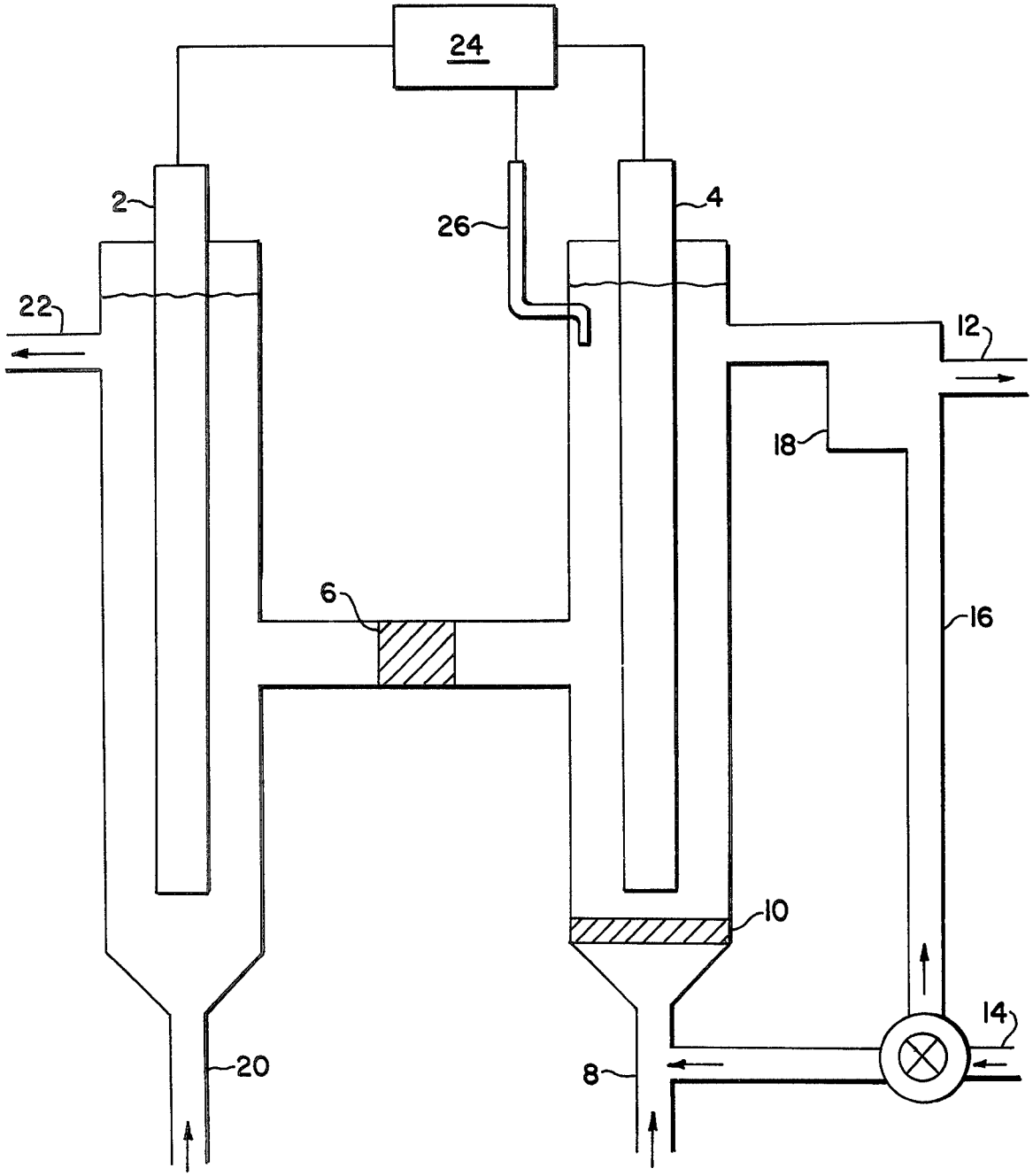
24
2
4
26
22
12
18
6
16
10
14
20
8

METHOD FOR OXIDATION OF AN ELEMENT IN BOTH COMPARTMENTS OF AN ELECTROLYTIC CELL

BRIEF DESCRIPTION OF THE INVENTION

The invention provides a method for obtaining up to twice the normal current yield by oxidizing the same element in both chambers of an electrolytic cell. For example, arsenic can be oxidized from As(III) to As(V) in the cathode chamber by means of an electrolytic cell when the arsenic is dissolved in water, or other suitable solvent containing oxygen which oxygen is reduced to hydrogen peroxide by a reducing agent alternatively referred to as a catalyst which may be physically or chemically attached to the cathode or dissolved in the catholyte. The reducing agent is characterized by having the capacity to reduce oxygen to hydrogen peroxide at a lower overpotential than at an electrode such as carbon. Typical reducing agents are cobalt porphyrins, hydroquinones and cobalt phthalocyanines. Typical examples include: cobalt tetrakis[N-methyl-4-pyridyl]-porphyrin, cobalt tetrapyridylporphyrin, tetraphenylporphinecobalt, cobalt phthalocyanine, cobalt tetrasulfonated phthalocyanine, 1,4-dihydroxybenzene, and 1,4-dihydroxynaphalene.

The hydrogen peroxide which is produced in the cathode chamber then oxidizes the As(III) to As(V). In the anode chamber the As(III) is also oxidized, preferably directly at the electrode serving as the anode, or via an electrogenerated oxidizing agent in the anode chamber which can be used to generate oxidants from halide ions such as bromide and iodide.

Typical electrodes employed are carbon glass, graphite, carbon and the like. Preferably the reducing agent is adsorbed or reacted onto the electrode. The electrolytic cell can be composed of conventional materials such as glass, metal, ceramic or plastic. The particular electrolyte, pH and electrolysis conditions employed depend on the elements to be oxidized, but the determination of which is within the skill of the art.

As used herein, the term "element" is intended to include an ionic form or part of an ionic compound or molecule.

BRIEF DESCRIPTION OF THE DRAWING

The drawing illustrates a schematic view of an electrolytic cell that can be used with the invention.

DETAILED DESCRIPTION OF THE INVENTION

The following detailed description and examples will serve to illustrate the invention and preferred embodiments thereof. All parts and percentages in said examples and elsewhere in the specification and claims are by volume unless otherwise indicated.

Referring now to the drawing, a typical electrolytic cell is shown in which the anode 2 and cathode 4 are separated by a divider membrane 6.

The electrolyte, element to be oxidized, $O_2$ source, reducing agent if not adhered to the cathode, and optionally a halide are passed via conduit 8 through disperser 10 into the cathodic compartment. There the $O_2$ is reduced to $H_2O_2$, the element oxidized by $H_2O_2$, and the oxidized product recovered via conduit 12.

In some cases, if the product hits the electrode it will reverse the reaction. In those cases, the element to be oxidized is passed via conduits 14 and 16 to mixing chamber 18 where contact with $H_2O_2$ is made. The optimum feed method for any particular element can be determined by simple experimentation.

The anodic compartment is fed via conduit 20 with electrolyte, the element to be oxidized and, optionally, halide. The product is removed via conduit 22. A controlled power source 24 and reference electrode 26 round out the typical electrolytic cell.

The following table illustrates examples of reactions which can be employed in accordance with the invention.

TABLE I

EXAMPLES OF REACTIONS

| Anodic Compartment | Cathodic Compartment |
|---|---|
| 1. $2I^- \rightarrow I_2 + 2e^-$ | 1. $O_2 + 2H^+ + 2e^- \xrightarrow{cat} H_2O_2$ <br> $H_2O_2 + 2H^+ + 2I^- \rightarrow 2H_2O + I_2$ |
| 2. $2Br^- \rightarrow Br_2 + 2e^-$ | 2. $O_2 + 2H^+ + 2e^- \xrightarrow{cat} H_2O_2$ <br> $H_2O_2 + 2H^+ 2Br^- \rightarrow Br_2 + 2H_2O$ |
| 3. $As(III) \rightarrow As(V) + 2e^-$ | 3. $O_2 + 2H^+ + 2e^- \xrightarrow{cat} H_2O_2$ <br> $H_2O_2 + 2H^+ + As(III) \rightarrow 2H_2O + As(V)$ |
| 4. (a) $As(III) \rightarrow As(V) + 2e^-$ <br> (b) $2Br^-(2I^-) \rightarrow Br_2(I_2) + 2e^-$ <br> $Br_2(I_2) + As(III) \rightarrow 2Br^-(2I^-) + As(V)$ | 4. (a) Same as 3 and, <br> $H_2O_2 + 2H^+ + 2Br^- \rightarrow Br_2 + 2H_2O$ <br> $Br_2 + As(III) \rightarrow 2Br^- + As(V)$ |
| 5. $2Br^- \rightarrow Br_2 + 2e^-$ | 5. Same as 2 followed by |

TABLE I-continued

EXAMPLES OF REACTIONS

Anodic Compartment

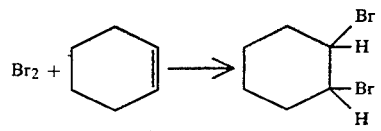

Cathodic Compartment

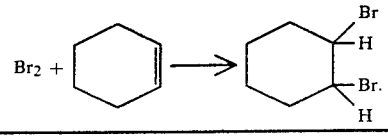

In the following Table II, data are presented which demonstrates production of $H_2O_2$ at high conversion efficiency using a reducing agent.

TABLE II

ELECTROCATALYTIC YIELD OF HYDROGEN PEROXIDE

| Exp. Conditions[a] | Total CHARGE (Q), Coulombs | Total $H_2O_2$ mole × $10^5$ | Yield[b] % |
|---|---|---|---|
| 0.32 mM CoTMPyP[e] $E_{cat}$ = −0.010 V[c] | 21.56 | 10.68 | 93.4 |
| 0.32 mM CoTMPyP $E_{cat}$ = −0.010 V | 44.05 | 21.68 | 95.0 |
| 0.28 mM CoTPyP $E_{cat}$ = −0.010 V | 27.8 | 13.4 | 92.6 |
| 0.29 mM CoTMPyP $E_{cat}$ = −0.200 V | 10.8 | 5.22 | 93.0 |
| 0.29 mM CoTMPyP $E_{cat}$ = 0.200 V | 39.4 | 18.4 | 90.0 |
| CoTPyP(ads.)[d] $E_{cat}$ = +0.200 V | 28.9 | 15.1 | 100 |
| CoTPyP(ads.)[d] $E_{cat}$ = −0.100 V | 48.9 | 23.3 | 92.0 |
| | | average | 93.7 ± 2.2 |

[a]0.05 M $H_2SO_4$ as supporting electrolyte; Tokai glassy carbon electrode with area of 11.4 $cm^2$.
[b]Based on Q/nF where n assumed as 2, and F equals 96,500 coulombs.
[c]$E_{cat}$ is the applied potential measured versus a reference Ag/AgCl(sat'd. KCl).
[d]Highly polished Glassy Carbon electrode immersed in 0.05 M $H_2SO_4$ solution containing dissolved cobalt porphyrin for ½ hr., rinsed with distilled water and then transferred to the electrolysis cell. The catalyst is cobalt tetrapyridylporphyrin.
[e]The catalyst is cobalt tetrakis [N—methyl-4-pyridyl]

In the following Table III data are presented that demonstrates that one can produce the product in both compartments of the cell.

TABLE III

ELECTROGENERATION OF IODINE

| $E_{cat}$(cathode)[a] | Total Charge (Q) Coulombs | Yield, % anode[b] | Yield, % cathode | Total yield, % |
|---|---|---|---|---|
| −0.10 V[c] | 54.4 | 100 | 90 | 190 |
| −0.10 V | 48.9 | 102 | 92 | 194 |
| 0.00 V | 55.4 | 102 | 91 | 193 |
| 0.00 V | 39.8 | 101 | 90 | 191 |
| +0.20 V | 12.4 | 102 | 98 | 200 |
| +0.20 V | 24.9 | 101 | 98 | 199 |
| | average: | 101 ± 1 | 93 ± 3 | 194 ± 3 |

[a]$E_{cat}$ is the applied electrode potential versus a reference Ag/AgCl(sat'd KCl) reference electrode.
[b]Electrolyte was 0.5 M $H_2SO_4$ and contained 0.1 M KI.
[c]$O_2$ was continuously bubbled through the cathode compartment during electrolysis. At the end of electrolysis, excess KI was added and $I_2$ formed was analyzed by titration with $Na_2S_2O_3$. The cathode consisted of CoTPyP adsorbed on a graphite rod and the electrolyte was 0.5 M $H_2SO_4$.

The data presented in the following Table IV demonstrate that the total yield is improved when bromide is added to the catholyte.

TABLE IV

ARSENIOUS ACID OXIDATION

| $E_{app}$(cathode)[a] | Yield Anode, % | Yield Cathode, % | Total Yield, %[b] |
|---|---|---|---|
| −0.30 V | 96 | 51 | 147(3) |
| −0.10 V | 95 | 59 | 154(3) |

TABLE IV-continued

ARSENIOUS ACID OXIDATION

| $E_{app}$(cathode)[a] | Yield Anode, % | Yield Cathode, % | Total Yield, %[b] |
|---|---|---|---|
| 0.00 V | 95 | 56 | 151(3) |
| +0.10 V | 95 | 62 | 157(3) |
| +0.20 V | 96 | 70 | 166(3) |
| | Avg: 95 ± 1 | 59 ± 5 | 155 ± 5 |
| −0.10 V | 95 | 59 | 154(1)[c] |
| −0.10 V | 93 | 76 | 169(1)[d] |
| −0.10 V | 98 | 77 | 175(1)[d] |
| −0.10 V | 95 | 89 | 184(1)[e] |

[a]$E_{app}$ measured versus a Ag/AgCl(sat'd KCl) reference electrode
Cathode: CoTPyP adsorbed on graphite rod; $O_2$ bubbled through solution during electrolysis.
Catholyte: 0.02 M $HAsO_2$ in 0.5 M $H_2SO_4$; vol. = 10 ml.
[b]Anode: graphite rod.
Anolyte: 0.02 M $HAsO_2$ in 0.5 M $H_2SO_4$ and 0.4 M KBr; vol. = 10 ml.
Number of coulombs passed through the cell varied from 20 to 45 Coulombs for each run; the number of runs at each $E_{app}$ are indicated in the parenthesis.
[c]Same as above except 0.1 M $H_3AsO_4$ added to catholyte and anolyte.
[d]Same as a and b except 0.4 M KBr added to catholyte.
[e]Same as a and b except 1.3 M KBr added to catholyte.

The data presented in the following Table V demonstrate that bromine can be generated in both compartments and then transferred to a separate vessel where it is reacted with cyclohexene to form dibromocyclohexane.

TABLE V

BROMINATION OF CYCLOHEXENE

| $E_{cat}$(cathode)[a] | Yield, % Anode[b] | Yield, % Cathode[c] | Total Yield, %[d] |
|---|---|---|---|
| −0.30 V | 90 | 45 | 135(1) |
| −0.10 V | 88 | 64 | 152(3) |
| −0.10 V | 89[e] | 64 | 153(1) |
| 0.00 V | 83 | 65 | 148(1) |
| +0.10 V | 87 | 66 | 153(1) |
| | | Avg. | 153 ± 5 |

[a]$E_{cat}$ measured versus a Ag/AgCl(sat'd KCl) reference electrode; number of coulombs passed through cell varied from 40 to 120 coulombs.
[b]Anode: graphite rod.
Anolyte: 0.5 M KBr or NaBr in 0.5 M $H_2SO_4$; vol. = 25 ml.
[c]Cathode: CoTPyP adsorbed on graphite rod.
Catholyte: $O_2$ bubbled through 0.5 M $H_2SO_4$ solution during electrolysis. After electrolysis stopped, 1 g. solid KBr or NaBr added to catholyte and the $Br_2$ produced was transferred by purging solution with $N_2$ or air gas streams to external reaction vessel containing cyclohexene ($CCl_4$ at ice temperature).
[d]Brominated cyclohexane analyzed by dissolving residue (left after $CCl_4$ evaporated) in 25 ml of ethanol and introducing small aliquote sample into conventional gas-liquid chromatograph. 1% DMF in ethanol served as an internal reference.
[e]Anolyte contained 1 M $HClO_4$ and 0.5 M NaBr.

While the above examples and results are illustrative of the invention, similar results can be achieved with other materials and conditions than those described in the specification as would be apparent to one of ordinary skill in the art. Accordingly, the invention is intended to be limited only by the appended claims.

What is claimed is:

1. A method of oxidizing an element in both compartments of an electrolytic cell which comprises reducing $O_2$ with a reducing agent contained in the cathode compartment to $H_2O_2$ which $H_2O_2$ oxidizes the element, and directly oxidizing the same element in the anode compartment.

2. The process of claim 1 wherein a bromide or iodide is oxidized at the anode to form a bromine or iodine oxidizing agent.

3. The method of claim 2 wherein iodide is oxidized.

4. The method of claim 2 wherein bromide is oxidized.

5. The method of claim 1 wherein the reducing agent in the cathode compartment is affixed to the electrode.

6. The method of claim 1 wherein the reducing agent is selected from cobalt porphyrins, cobalt phthalocyanines and hydroquinones.

7. The method of claim 1 wherein the reducing agent is cobalt tetrakis[N-methyl-4-pyridyl]porphyrin.

8. The method of claim 1 wherein the reducing agent is cobalt tetrapyridyl porphyrin.

9. The method of claim 1 wherein the reducing agent is cobalt phthalocyanine.

10. The method of claim 1 wherein the reducing agent is cobalt tetrasulfonated phthalocyanine.

11. The method of claim 1 wherein the reducing agent is 1,4-dihydroxybenzene.

12. The method of claim 1 wherein the reducing agent is 1,4-dihydroxynaphthalene.

13. The method of claim 1 wherein the reducing agent is tetraphenylporphinecobalt.

14. The method of claim 1 wherein the anode and cathode compartments are separated by a membrane which is ion permeable but impermeable to solutions contained in the compartments.

15. The method of claim 14 wherein the membrane is a microporous laminate of a perflourosulfonic acid resin with a fabric of polytetrafluoroethylene.

16. The method of claim 1 wherein bromide is present and is oxidized to bromine which is removed by an inert gas and is reacted with cyclohexene to form dibromocyclohexane.

17. The method of claim 1 wherein a halide is present in the cathode compartment.

18. The method of claim 17 wherein the halide is bromide.

19. The method of claim 17 wherein the halide is iodide.

20. The method of claim 1 wherein the element is As(III) which is oxidized to As(V).

* * * * *